United States Patent [19]

Smith

[11] Patent Number: 5,045,833

[45] Date of Patent: Sep. 3, 1991

[54] APPARATUS AND SYSTEM FOR ALERTING DEAF PERSONS

[76] Inventor: Edward R. Smith, 53 Belcher Rd., Blairstown, N.J. 07825

[21] Appl. No.: 359,037

[22] Filed: May 30, 1989

[51] Int. Cl.[5] ..... G08B 5/06

[52] U.S. Cl. ..... 340/332; 340/693; 340/407

[58] Field of Search ..... 340/332, 331, 407, 521, 340/626, 691, 693, 320; 200/81 H, 837

[56] References Cited

U.S. PATENT DOCUMENTS

| | | | |
|---|---|---|---|
| 2,875,291 | 2/1959 | Armstrong et al. | 200/81 H |
| 3,786,628 | 1/1974 | Fossard et al. | 58/152 B |
| 3,810,170 | 5/1974 | Zinsmeister | 340/420 |
| 4,180,810 | 12/1979 | Muncheryon | 340/407 |
| 4,298,863 | 11/1981 | Natitus et al. | 340/626 X |
| 4,365,238 | 12/1982 | Kollin | 340/407 X |
| 4,380,759 | 4/1983 | Sulkoski et al. | 340/407 |
| 4,384,183 | 5/1983 | Meshoulam | 200/81 H X |
| 4,553,138 | 11/1985 | Nakanishi et al. | 340/584 |
| 4,668,935 | 5/1987 | McDermott | 340/332 |
| 4,694,281 | 9/1987 | McDermott et al. | 340/331 X |
| 4,717,910 | 1/1988 | Scripps et al. | 340/693 |

*Primary Examiner*—Joseph A. Orsino
*Assistant Examiner*—Brian R. Tumm
*Attorney, Agent, or Firm*—Steele, Gould & Fried

[57] ABSTRACT

An improved actuator device is disclosed which comprises a combination of activators, switches, indicator lights and power outlets for providing an alarm to those persons of impaired hearing. The device comprises a housing which has electrical power supplied thereto and switches for transmitting the received electrical power therefrom. An indicator circuit is provided to signal the activation capability of the device. Associated with the device is a pneumatic pressure switch which is activated when increased pneumatic pressure is applied to the switch, pressure being applied through a squeeze bulb and tubular conduit connecting the squeeze bulb to the switch. Other indicators and sensor switches can be associated with the device to alert one of impaired hearing to multiple dangerous situations or events.

7 Claims, 2 Drawing Sheets

APPARATUS AND SYSTEM FOR ALERTING DEAF PERSONS

BACKGROUND OF THE INVENTION

1. Field of the Invention

This invention relates to a signaling device for alerting deaf persons to various conditions, including dangers as well as more mundane situations, such as a phone call or the presence of a visitor.

2. Description of the Prior Art

For most of the human population, alerting devices for the home and for commercial facilities such as hotels, rely primarily on sound to alert persons within audible range to the occurrence of certain events requiring the persons' attention, for example certain dangers. Smoke alarms produce a loud, high pitched or pulsating sound to alert persons to the danger of fire; typically doorbells rely on chimes or bell sounds to signal a presence at the door; alarm clocks employ buzzers or bells, often driven mechanically or electromechanically; and telephones utilize a bell, often driven electromagnetically. The audible alarm method as a means for alerting persons having impaired hearing of course is, in most cases, ineffective and unsuitable. As means of addressing this problem, numerous alerting systems have been developed to rely on other indicators more readily noticed by the persons to be warned.

U.S. Pat. No. 3,786,628 to Fossard et al discloses a warning device particularly useful for the deaf or partially deaf which comprises a mechanical vibration generator responsive to signals produced by a trigger signal generator. The trigger signal generator is actuated by any of a plurality of external sources of sound, namely, an alarm clock, a doorbell or a car horn. The alerting device produces mechanical vibrations of a fixed or variable frequency, which mechanical vibrations are sensed tactilely by the person to be alerted.

U.S. Pat. No. 4,380,759 to Sulkowki et al discloses an apparatus for alerting those having impaired hearing which utilizes a vibrating reed which is actuated by triggering signals from a radio receiver. The device resembles a portable "beeper". The "beeper" radio receiver is equipped with an antenna and is equipped with reception means for receiving alarm signals such as those emitted by a smoke alarm having a radio output signal. When activated, the vibrating reed pulses and is sensed by the person with impaired hearing due to tactile contact.

U.S. Pat. No. 4,553,138 to Nakanishi et al discloses an alarm system which comprises a means for sounding an alarm, with a tactile indicator for a disabled person. The system is particularly suited for bedridden persons who cannot call for help, but require a device for alerting others of their difficulty. The alarm system includes a stationary body and a movable body, wired to the stationay body, with the stationary body being equipped with sensing means. An alarm means on the stationary body is activated in response to the sensing means. The movable body, which is attached to the disabled person, is equipped with a vibration-type buzzer which, when activated, effects a vibration which can be felt by the person to confirm the alarm status, which can be initiated by the disabled person. The remote unit contains a control switch which may be activated by the person to initiate an alarm which will alert others to the call from the person, and this "calling for help" status is fed back to the impaired person by the tactile indicator.

Tactile systems are effective non-auditory alarms but require a vibratory output device in contact with the person to be signalled. These devices have sometimes been preferred over devices having visual alarms because the person to be alerted may be unable to see a light flashing on an alarm device or the like. However, they are not generally available devices and generate expenses. Moreover, many such devices must be wired to the person to be alerted, which is unacceptable.

It is also possible to employ visual signalling as an alternative to auditory signalling. In order to be effective, for example, to wake a sleeping hearing-impaired person, the power level of the visual signalling must be substantial. The flashing of a panel light on an alarm device is unlikely to suffice. However, the flashing of a room light normally is enough stimulus to wake a hearing-imparied person, who is relatively more attentive to visual stimule than persons with nominal auditory acuity.

U.S. Pat. No. 3,810,170 to Zinsmeister disclosed a visual signaling system for the deaf which is effected through a high intensity lamp such as a strobe lamp. The visual signaling system is actuated via an alarm system equipped with a control panel having various distinct indicator means to indicate fire, a call at the door, etc. Inasmuch as the light (although bright) is a small panel lamp, the person to be alerted should be looking at or toward the area of the flashing light in order to notice it, because the light is directly on the control panel rather than a widely-broadcast light source such as a room light, table lamp or the like.

U.S. Pat. No. 4,180,810 to Muncheryan discloses a device for awakening a sleeping person which is particularly adapted for persons with impaired hearing. In the background portion of the patent it is mentioned that flashing lights had been tried to visually alert or signal those persons of impaired hearing to dangers and other situations, but that such visual signaling often was ineffective where the person was asleep or facing away from the flashing light. Another problem mentioned with respect to with visual signaling was that such visual signaling also alerted or awakened others. The patent therefore featured to the physical tactile stimulating signals method, to awaken both deaf persons and persons of normal hearing when asleep. The physical stimulating signal was activated by a receiver capable of distinguishing audio-frequency signals eminating from smoke detectors or other sounds, e.g., an alarm clock or telephone.

SUMMARY OF THE DISCLOSURE

This invention relates to an improved apparatus and system specifically designed for those of impaired hearing, and permits the transmission of an alarm to general purpose power-consuming devices, i.e., either a visual or physical (tactile) stimulus. Although a local panel light indicator can be included to convey visually to the person of impaired hearing the nature of the alarm, the preferred alarm is a visual one and is not limited to a flashing light on an alarm panel. The device comprises a preferably portable housing having means for sensing and passing along an alarm signal. A power supply inlet and a power supply outlet connect to domestic power sources and to as broad ranging a stimulus produces as needed, for example a table lamp or floor lamp. A plurality of condition-responsive switching means, when activated by sensing an alarm condition, connect power from the inlet to the general purpose power outlet. In addition, the circuit includes a continuity indicator effective to alert the person of impaired hearing that the power supply inlet is active and tha the load, e.g., a table lamp or tactile vibrator is connected and enabled. The device is capable when a switch means is triggered to transmit to the power outlet sufficient power to effect visual signaling or physical stimulus to the person of impaired hearing. The switching means are preferably substantially instantaneously responsive, for example using a triac or "solid state relay", whereby the source of the alarm is indicated by the character of flashing of the switched output power. The user preferably plugs a room lamp, table lamp or other area-lighting means into the power outlet, whereby general area light flashing variations, in a pattern characteristics of the source, alert the user. The sensing means preferably includes a pneumatic pressure sensitive switch attachable by a connecting tube to an air bulb, at least one audible signal sensor for a smoke alarm, phone or similar tone, and a means sensing electromagnetic variations characteristic of a solenoid such as the bell driver of a telephone.

There are several advantages associated with the device of the present invention in that notwithstanding an output of switched full power AC current and the capability of a widely broadcast visual output, the device is compact and easily transported by the person of impaired hearing. The device can be energized at essentially all locations where there is electrical power and area switchable electrically powered stimulus generators, e.g., lamps. Thus, for example, the device lends itself for travel and greatly enhances the ability of the deaf to move from facilities such as hotels or within a work environment with the comfort that they need not rely solely on an auditory alarm system, but can rely on their alerting device which responds to a variety of alarms and signals.

It is an object of the invention to alert persons of impaired hearing using a small and portable sensor and switches, for connecting full power to wide-broadcast alerting means.

It is a further object to permit a person of impaired hearing to adapt conveniently to facilitate such as hotels, that are routinely configured only for persons responsive to audible stimuli.

It is yet another object to provide a convenient personal alerting device with generally-useful inputs and a high powered generally-useful output.

These and other objects will be more readily ascertainable to one skilled in the art from a consideration of the following figures, description and exemplary embodiments, with the understanding that the drawings are illustrative only and that changes may be made in the specific construction illustrated and described within the scope of the appended claims.

BRIEF DESCRIPTION OF THE DRAWING(S)

DETAILED DESCRIPTION OF THE PREFERRED EMBODIMENT(S)

Figure 1:
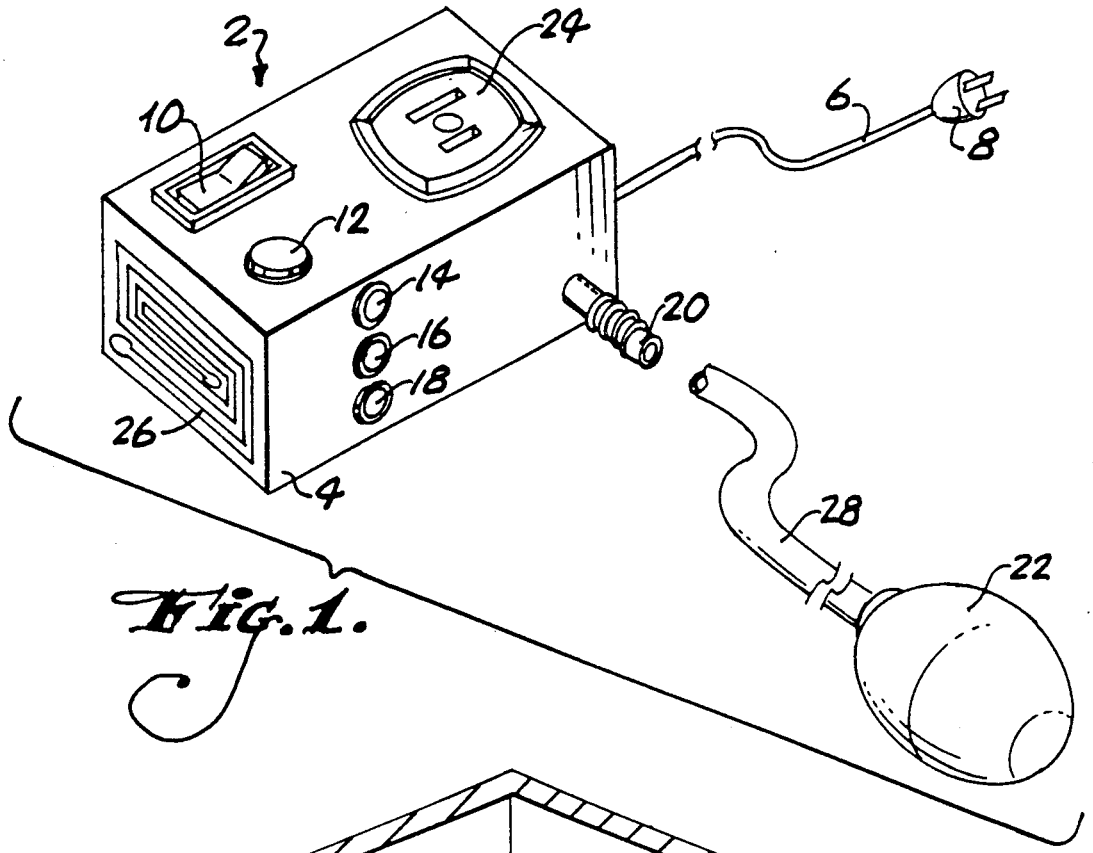
FIG. 1 is a perspective view of the actuating device for the alarm system.

To facilitate an understanding of the invention, reference is made to FIG. 1, which is a perspective view of an actuating device for an alarm system according to the invention. The actuating device 2 generally comprises a housing 4, which may be a small, portable box. The box is generally rectangular in shape and carries the sensing and certain of the actuating components of the device. Power is supplied through electrical cord 6 which consists of a standard two or three conductor electric wire for connection to a standard source of domestic power via standard plug 8, typically 110 VAC at 60 Hz, at a wall outlet or the like. The housing 4 carries an on-off switch 10 which permits the actuator device to be enabled on moving switch 10 from the off position to the on position. A "test" switch (not shown) can be included to connect power directly to the output for testing the stimulus producing means, ie., the load. The "on" position can be confirmed by including indicator light 12, which will light provided there is continuity between the contacts of the power outlet. Various other indicators can be carried by the housing 4, e.g., specific indicators for distinguishing specific sensed condition such a indicator light 16 for a telephone and indicator light 18 for a door alarm.

The operative portion of the actuator device lies in the signal receiving and switching means carried within housing 4. In more detail, housing 4 has a tubular extension 20 for conveying a pneumatic pressure differential supplied by bulb 22. Lastly, housing 4 is equipped with an electromagnetic coil means 26, which is a form of antenna for receiving electromagnetic signals, where appropriate, for activating the appropriate alarm. When the actuator device 2 receives a signal by virtue of an alarm, appropriate switches such as a relay, thyristor or the like to be described, close the circuit between the power supply inlet and provide 110 V at 60 Hz through power supply outlet 24. Power supply outlet 24 is a standard receptable for receiving a conventional electric plug from appropriate signaling devices which respond to the power supply.

Figure 2:
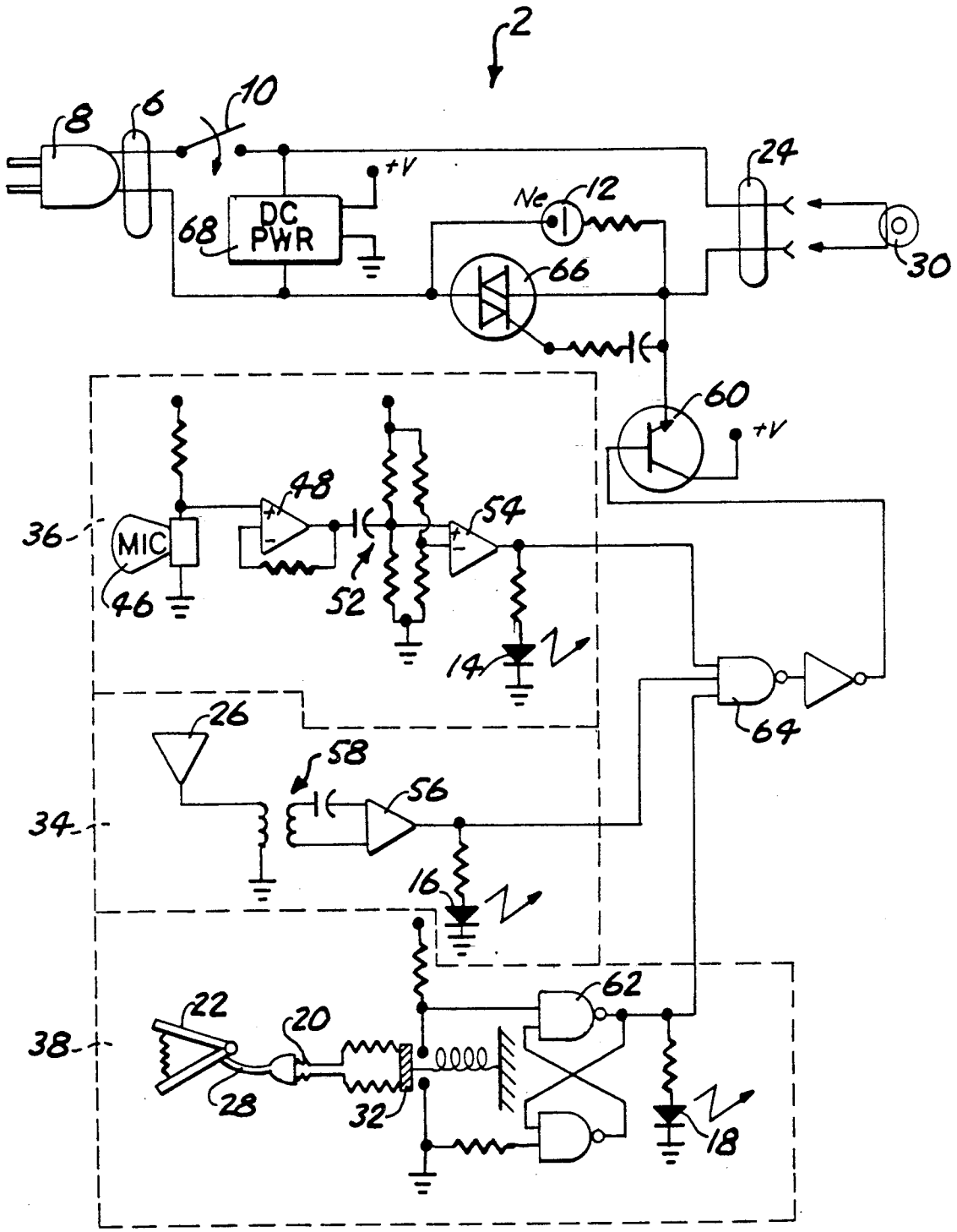
FIG. 2 is a schematic diagram of an electrical circuit for the actuating device described in FIG. 1.

A simplified schematic electrical circuit is described in FIG. 2, which illustrates the multiple activating mechanisms for the alarm device 2. The device is entirely portable, relying on an indicator such as a floor lamp, table lamp, etc. at the destination. A person having impaired hearing transports the device to any appropriate location and enables the devices by inserting plug 8 into a wall socket for receiving electric current, typically from a 110 volt standard domestic power source. Of course, the device is fully applicable at other voltages and other power line frequencies the most typical 110 VAC, 60 HZ. The electric current is connected via electric cord 6 to the sensing and switching circuits in the device, which are activated upon closing on/off switch 10. On closing switch 10, power is applied and an indicator light 12 is illuminated to indicate that the device is operative by means of an enabled load. Light 12 is on when there is an appropriate power supply for powering an alert device, e.g., an electric lamp, and there is a load connected across the outlet contacts 24 (i.e., plugged in and itself turned "on")

Figure 3:
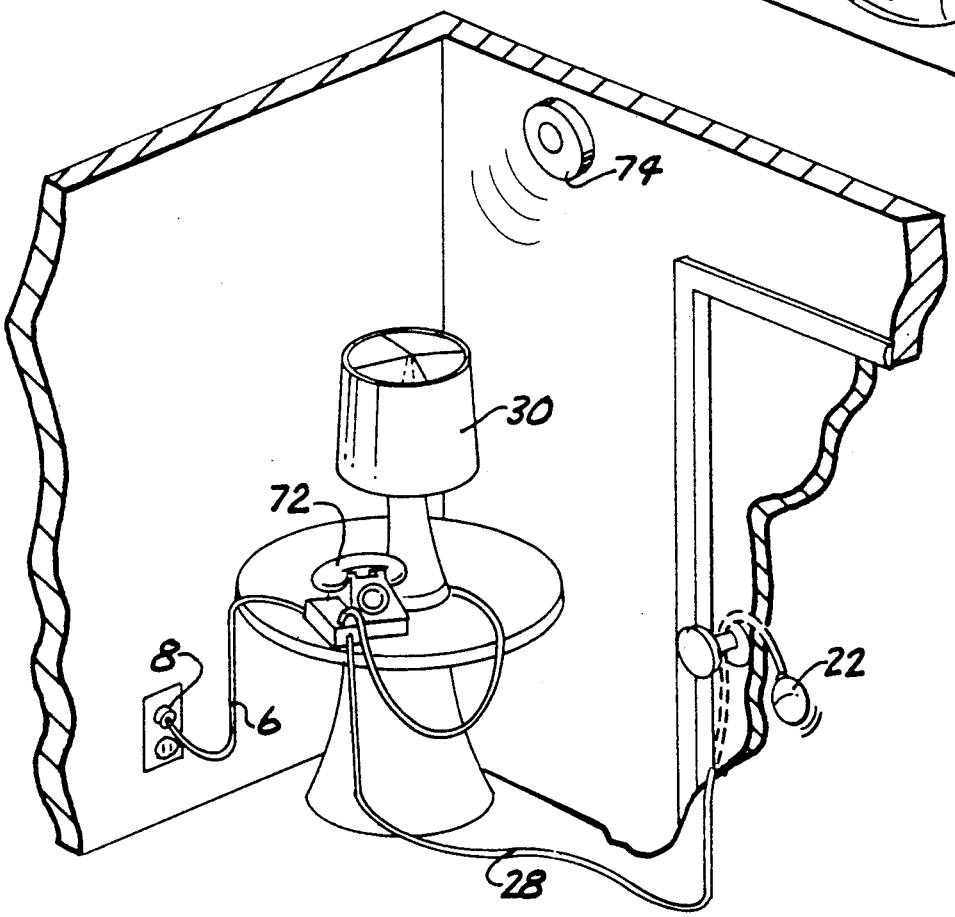
FIG. 3 is a diagrammatic view showing use of an electric lamp for visual signaling.

An alerting device 30, which has a resistance, is plugged into the actuator device through power outlet 24. Typically, alerting device 30 is a visual signaling system such as an electric table lamp or floor lamp as shown in FIG. 3. However, if the unit is to be adapted for a visually nonresponsive person, e.g., a person asleep in the daytime, a vibrating reed or other physical stimulus may be utilized. When switch 10 is closed, lamp 12 becomes connected across the power line in series with the resistance of the alerting device (e.g., floor lamp or the like). Lamp 12 is thus effective not only to show that power is available at plug 8, but also to show that there is continuity through the alerting device. If lamp 12 is a neon lamp, only a very small current flows and substantially all the resistance across the power line is due to lamp 12. Therefore lamp 12 lights, but the alerting device does not receive enough current to light. Alternatively, lamp 12 can be an incandescent lamp connected in parallel to the load on the power line side of switch 10. In that case, lamp 12 does not show continuity through the alerting device, but only available power.

The mechanism for alerting the person of impaired hearing to danger or to some other outside source, preferably is effected through a variety of alternatively or concurrently operable sensor means. One such means includes a pneumatic pressure switch 32 which is connected by a conduit to tubular extension 20. Bulb 22 can be placed, for example, at the end of extension 20 and outside the owner's door, and forming a closed compressible volume, attached to the pressure switch. Persons who wish to alert the owner squeeze or step on the bulb, closing contacts operable to connect power to the switched outlet 24, and therefore to the alerting device. Squeezing pressure bulb 22 increases the pneumatic pressure in the line and causes pressure switch 32 to close and be displaced against its resilient bias, e.g., a spring. The switch 32 can connect power directly to alerting device 30, or can operate a relay or thyristor, e.g., triac 66. An individual indicator light 18 can be coupled with pressure switch 32, and thus, when the general purpose stimulus is produced, indicate to the person of impaired hearing that the alarm was caused by a party squeezing the pressure bulb 22, rather than by another of a plurality of sources.

The pressure switch nature of the bulb and switch means produces a signal that is characteristic of its source, effectively distinguishing one source of alarm from another, even without specific indicator lights, e.g. light 18. The pressure switch closes and stays closed so long as pressure is applied to the bulb 22. The characteristic effect on the indicator is a full-on condition for at least a few seconds which is distinguishable from signals characteristic of the other indicators, which flash in a manner dictated by the source of the signal.

A second means for alerting a person of impaired hearing to an alarm is through an electromagnetic sensor. The electromagnetic sensor detects an electromagnetic signal such as that transmitted by a nearby coil, e.g., the bell of a telephone. The device will likewise detect magnetic flux from other, relatively high power sources, e,g. a solenoid from a doorbell. When engaged, an appropriate signal is sensed by electromagnetic sensor 34, namely by current induced in a coil 26. The induced current is amplified and indicated via alerting device 30 and indicator light 16, and operates the output switch means.

The characteristic output produced by a telephone is an alternating (somewhat irregular) flashing, e.g., for 2 seconds, followed by a pause of the same time interval, in a periodically repeating pattern. In order to couple with a telephone bell coil, the sensing coil 26, a form of antenna, must be placed as close as possible to the bell coil, e.g., directly against the telephone set. The user may also wish to experiment by placing the device on different sides of the phone to best intercept the lines of magnetic flux.

Actuator device 2 is further equipped with an audio receiver. The signal produced by a microphone is amplified and filtered to discriminate for an audio signal of a frequency such as that transmitted by a smoke detector. The output of a smoke detector can be detected by radio signal as well, provided the smoke detector is so equipped. Either an audio signal or a radio signal can be continuous, pulsed, or even encoded by a pulse pattern. Preferably the signal is continuous and is distinguished by its frequency.

The electrical circuits responsive to the sensors can be used to activate relays that directly connect power from plug 8 to receptacle 24 when the relays are energized by detection of a signal. Preferably the output is held activated (powered) until the signal is terminated. Other variations can be utilized, such as, for example, a variation where a switch or relay latches on and remains closed until reset, once activated. Once latched, the device may be reset only by the de-activation of the actuator device, for example, by moving switch 10 from the on position to the off position. Actuation occurs when the switch is moved back to the on position. Another variation is that the switches, once activated, open and close at a preselected frequency, for example as defined by one-shot timers (not shown) having different pulse widths for distinguishing among the different possible sources of the alarm. The preselected frequency of opening and closing of the switch may act as a means for effecting a visual signal and thus means for reporting the nature of the alarm.

The advantage of using a variety of switch activation systems, particularly the pressure switch activation which is transmitted by a pressure bulb 22, is that the pressure bulb 22, in itself, is a mechanism for alerting other parties that a room or specific location is inhabited by a person of impaired hearing. the activating mechanism can be taken virtually anywhere, e.g. a hotel, and the bulb placed outside the door.

The physical nature of the alerting unit 2 is shown substantially in FIG. 1. FIG. 2 illustrates a schematic diagram of elements adapted to serve the necessary sensing and switching functions, according to the invention. FIG. 3 shows applying the invention to a particular environment, namely a hotel room.

With reference to FIG. 2, AC power is supplied by a plug 8 and connection line 6, switch 10 being provided to connect the AC power to an internal DC power supply 68, and also to the alerting device 30, in this case a conventional table lamp, via switching means 66. In the illustrated embodiment, switching means 66 is a triac, namely a thyristor with bi-directional triggerable conducting elements controlled via a gate input. Three sensing circuits 34, 36, 38 are provided for sensing electromagnetic effects, acoustic signals, and a pressure signal, respectively. The output of these sensors drives the gate input of triac 66, via drive transistor 60. Status indicating lamp 12 is provided for indicating the operable status of the alerting devices. LEDs 14, 16, 18 are provided for showing visually the alert status of the acoustic, electromagnetic, pressure sensors, respectively.

Status lamp 12, which may be a neon lamp, is a very high resistance element, and is connected to bridge across the triac 66 or other switching element. Accordingly, whenever switch 10 is closed and there is a resistance defined by an alerting device 30 (e.g., the table lamp) neon lamp 12 will light. Neon lamp 12 thus indicates not only the availability of power at plug 8, but also indicates the connection of an alerting means 30. Neon lamp 12 will not light if, for example, lamp 30 is switched off locally.

Sensor circuits 34, 36, 38 are responsive to specific emergent situations. The audio sensor 36 has a microphone 46 at the input to an amplified circuit. Amplifier 48, namely a feed-back amplifier, increases the signal level from microphone 46. The output of amplifier 48 is passed through a filter defined by resistive and capacitive or inductive elements 52, in this case a high pass filter adapted to pass the high pitched signal of a smoke detector, blocking lower frequencies. Whenever the signal level passing the high pass filter elements 52 exceeds a predetermined threshold defined by the resistor elements applied to the inverting input of threshold detector 54, the output of the threshold detector 54 goes high. This lights specific indicator LED 14, and causes the output of gate 64 to change state. Transistor 60 then conducts, turning on the switching mechanism, for example triac 66 and powering alerting device 30.

Assuming a constant tone emitted from the smoke detector and detected at microphone 46, the output of acoustic sensor 36 will remain activated so long as the tone is activated. Therefore, the user will perceive the smoke detector alarm as the light 30 coming on and staying on. Different results are achieved with the electromagnetic detector 34. In this case, an electromagnetic detecting coil 26, namely a form of antenna, is placed by the user in close proximity to the solenoid coils of a telephone bell ringing circuit. By means of tuned elements 58, namely inductances, capacitances and/or resistances, the characteristic frequency of the bell ringer is passed to amplifier 56 and other frequencies are blocked. The output of amplifier 56 also drives a specific indicator LED 16, and operates gate 64, transistors 60 and triac 66. The characteristic output produced by electromagnetic 34 responsive to the ringing of the telephone bell is irregular during the bell sounding and silent between bell soundings. As a result, the user can distinguish between smoke alarm alerts and telephone bell ringing alerts by means of their distinguishable effects on lamp 30.

One might inquire why a person of impaired hearing needs to be alerted when a telephone rings, the telephone being an acoustic device. Persons of impaired hearing, however, also operate data terminals through their telephones and even without the need for audio communications, may have use for the telephone, for example a wake-up call in a hotel, or some other signaling need.

A further detector 38 is responsive to pressure on bulb 22. No amplification is needed in this case, the bulb 22 producing a pressure increase in tube 28 and tube inlet 20, causing pressure-sensitive switch 32 to close. Switch 32 is connected to a latch means 62, providing an output switch that changes state so long as the pressure switch 32 is closed. As in the other detectors 34, 36, pressure-sensitive detector 38 can be provided with an individual indicator, LED 18, and is connected through gate 64 and drive transistor 60 to switching means 66, namely the triac.

The circuitry shown in FIG. 2 is representative of a class of detectors, it also being possible to vary the specific circuits and devices as needed. For example, the threshold detector 54 in audio detector 36 may be omitted, or a similar threshold detector can be included in the electromagnetic detector 34. A resonant reed may be provided in lieu of microphone 46, amplifier 48 and tune circuit 52.

The use of the apparatus is shown in FIG. 3. The device of the invention being a general purpose alerting apparatus, it is useful as a portable device which the person of impaired hearing can take to a hotel room or the like, using available apparatus, apart from the portable device 2. As shown in FIG. 3, the apparatus is connected to a source of electric power via plug 8 and switch 6, and is positioned immediately adjacent telephone 72 such that the electromagnetic detector 34, and specifically coil 26 thereof, is in close range of the solenoid coils in the telephone 72. The alerting device, in this case table lamp 30, is plugged directly into outlet 24 of device 2. Accordingly, whenever one of the sensed conditions causes device 2 to close its relay, for example the solid state relay defined by triac 66, lamp 30 will light. The user is made aware of the fact that lamp 30 is turned on, its bulb operative etc., by means of indicator light 12. Indicator light 12 is sensitive to continuity across the contacts of plug 24.

The other sensor inputs are responsive to the high pitched acoustic output of smoke alarm 74 and also to the pressure from bulb 22 via tube 28. Bulb 22 can be hung outside the user's door, for example over the doorknob, and may include an appropriate legend whereby visitors are made aware that is is necessary to operate bulb 22 rather than a doorbell, or other auditory-type alarm, in order to alert the person in the room.

The invention having been disclosed, other variations will now become apparent to persons skilled in the art. Reference should be made to the appended claims to assess the scope of the claims.

To summarize, the alerting device provices an effective means for providing a signal of various events to a person who has impaired hearing. The ability to utilize the actuator device at almost all locations allows the person of impaired hearing to move and travel freely without the fear associated with the unawareness of a dangerous situation.

The invention as disclosed in an apparatus 2 to alert a deaf person of an emergent situation, including a housing 4 equipped with a reception means 8, 6 for supplying electrical power thereto and means 24 for transmitting electrical power therefrom, said housing being equipped with a switch 66 and indicator means 12, 14, 16, 18 for detecting and indicating presence of electrical power supplied to said housing, said housing carrying conduit 20, 28, 22 for transmitting a pneumatic pressure differential occurring outside the actuator housing to a pressure switch means 32 capable of detecting such pressure differential within said housing, such that when said pneumatic pressure differential is detected, said switch means 66 effects connection of the electrical power to the power supply outlet and thus to an alerting device exterior from said actuator housing. The housing preferably carries an indicator circuit 62, 18 associated with said pneumatic pressure switch means 32, such that when said pneumatic pressure switch means 32 is engaged, said indicator 62, 18 is engaged. The housing may also carry and electromagnetic sensor 34, connected to operate the switch means, associated between the power supply inlet and the power supply outlet, such that when the magnetic sensor 34 and the switch means 66 are engaged, power is transmitted from the power supply inlet to the power supply output. The electromagnetic sensor 34 may be provided with an indicator 16, engaged when the electromagnetic sensor 34 and the swtch means 66 are engaged.

The housing 2 preferably carries an audio detector 36 connected to operate the switch means 66 such that when a preselected audio signal is detected, the switch means 66 is engaged and power is transmitted from the power supply inlet to the power supply outlet.

The switch means connecting the electric power to the outlet can be a thyristor 66, and the outlet 24 is preferably a general purpose electrical outlet, for receiving conventional elements such as a table lamp 30. The acoustic sensor 36 is preferably specifically responsive, by means of tuned circuits 52, to the acoustic signal produced by a smoke detector and/or fire alarm. The pneumatic sensor is preferably connected by means of an elongated tube 28, to a pressure bulb 22, which the user can hang outside a door from the housing tube.

Having now illustrated and described my invention, it is not intended that such description limit this invention, but rather that this invention be limited only by reasonable interpretation of the appended claims.

What is claimed is:

1. An apparatus to alert a deaf person of an emergent situation, comprising:

a housing equipped with a reception means for supplying electrical power thereto and an outlet means including a power supply outlet for transmitting electrical power therefrom, said housing equipped with a switch and indicator means for detecting and indicating presence of electrical power supplied to said housing, said housing carrying a conduit for transmitting a pneumatic pressure differential exterior from said housing to a pneumatic pressure switch means capable of detecting said pressure differential within said housing, such that when said pneumatic pressure differential is detected, said pressure switch means effects connection of electrical power to the power supply outlet and thus to an alerting device exterior from said housing.

2. The apparatus of claim 1 further comprising an additional indicator means associated with said pneumatic pressure switch means such that when said pneumatic pressure switch means is engaged said additional indicator means is engaged.

3. The apparatus of claim 2 wherein said housing carries an electromagnetic sensor connected to operate a power switch means, associated between a power supply inlet and the power supply outlet such that when said electromagnet sensor operates to engage said power switch means, power is transmitted from said power supply inlet to said power supply outlet.

4. The apparatus of claim 3 wherein said electromagnetic sensor and said power switch means are operative to activate said additional indicator means, which is engaged when said electromagnetic sensor and said power switch means is engaged.

5. The apparatus of claim 2 wherein said housing carries an audio detector connected to operate a power switch means such that when a preselected audio signal is detected, the power switch means is engaged and power is transmitted from a power supply inlet to the power supply outlet.

6. A method for alerting persons to any of a plurality of emergent situation and to visitors, comprising the steps of:

connecting to a source of electric power a power switching device, the power switching device operated by a pneumatic pressure switching device responsive to a pressure differential, the power switching device being responsive to said situations and operable when triggered to switch power to a standardized domestic power receptacle;

connecting to the power switching device a plurality of sensors operable to detect each of the emergent situation, said plurality of sensors including the pneumatic pressure switching device;

connecting to the domestic power receptacle an available stimulus producing device normally connected directly to the source of electric power;

connecting to the pneumatic pressure switching device a conduit and a bulb, forming a closed volume compressible by squeezing the bulb;

placing the bulb outside a door to be found by the visitor;

connecting to the power switching device the pneumatic pressure switching device; and, indicating presence of a visitor by said pneumatic pressure switching device in response to a pressure differential.

7. The method according to claim 6, further comprising labeling the bulb to indicate that the bulb is to be squeezed to generate an alert signal.

* * * * *